US005738511A

United States Patent [19]

Borah et al.

[11] Patent Number: 5,738,511

[45] Date of Patent: Apr. 14, 1998

[54] VERTICAL SHAFT KILN

[75] Inventors: Umesh Chandra Borah; Pranab Barkakati; Dilip Kumar Dutta; Jayanta Jyoti Bora; Paran Phukan; Nc Dey; Wahid Ahmed; Subodh Chandra Kalita; Dipak Bordoloi; Ajit Baruah, all of Assam, India

[73] Assignee: Council of Scientific & Industrial Research, New Delhi, India

[21] Appl. No.: 660,117

[22] Filed: Jun. 7, 1996

[51] Int. Cl.[6] ..... F27D 1/08

[52] U.S. Cl. ..... 432/95; 432/96; 432/97; 432/98; 432/99; 432/100; 432/101; 432/106

[58] Field of Search ..... 432/95, 96, 97, 432/98, 99, 100, 101, 106

[56] References Cited

U.S. PATENT DOCUMENTS

| | | | |
|---|---|---|---|
| 2,739,800 | 3/1956 | Sisco | 432/98 |
| 3,954,381 | 5/1976 | Marecaux | 110/215 |
| 3,954,391 | 5/1976 | Gottlieb | 432/95 |
| 4,013,401 | 3/1977 | Georgiev et al. | 432/95 |
| 4,254,221 | 3/1981 | Beckenbach | 432/98 |
| 4,332,641 | 6/1982 | McConaghy et al. . | |
| 4,347,120 | 8/1982 | Anderson et al. . | |
| 4,352,661 | 10/1982 | Crookston et al. . | |
| 4,407,700 | 10/1983 | Davis et al. . | |
| 4,409,068 | 10/1983 | Davis et al. . | |
| 4,473,352 | 9/1984 | Sonoda et al. | 432/99 |
| 4,718,984 | 1/1988 | McConaghy, Jr. et al. . | |
| 4,747,773 | 5/1988 | Predescu et al. . | |

*Primary Examiner*—Henry A. Bennett
*Assistant Examiner*—Jiping Lu
*Attorney, Agent, or Firm*—Morgan & Finnegan LLP

[57] ABSTRACT

This invention relates to a a vertical shaft kiln (VSK) useful for manufacturing cement and other allied products, which comprises a rotary nodule feeder for feeding the raw materials, fitted above the kiln bed for uniform distribution of nodules of the raw materials, an air blower being placed at the base of the kiln for feeding air through a duct to a common air header having a plurality of outlet air ducts, the air duct being connected to an air cone placed inside an armoured shell of the VSK, the said air cone being provided with a grate assembly having a plurality of peripheral air slots, the air duct being connected to an air box placed above the said armoured shell, the said air box having perforations on the inside vertical wall, the air duct being connected to an air header having air entry nozzles placed in such a manner so as to supply air just below the sintering zone of the VSK, the air duct being connected to the chimney of the VSK, the said chimney being provided with a butterfly valve below the air duct, the chimney being also provided with a bypass duct below the said butterfly valve, the bypass duct being connected through means to a cyclone separator fitted with a fan for drawing the stack gases, the outlet of the cyclone separator being connected to an outlet duct through a scrubber, a sensor alarm being provided on the VSK body to indicate fire bed level, the products being removed through a discharge chute.

2 Claims, 1 Drawing Sheet

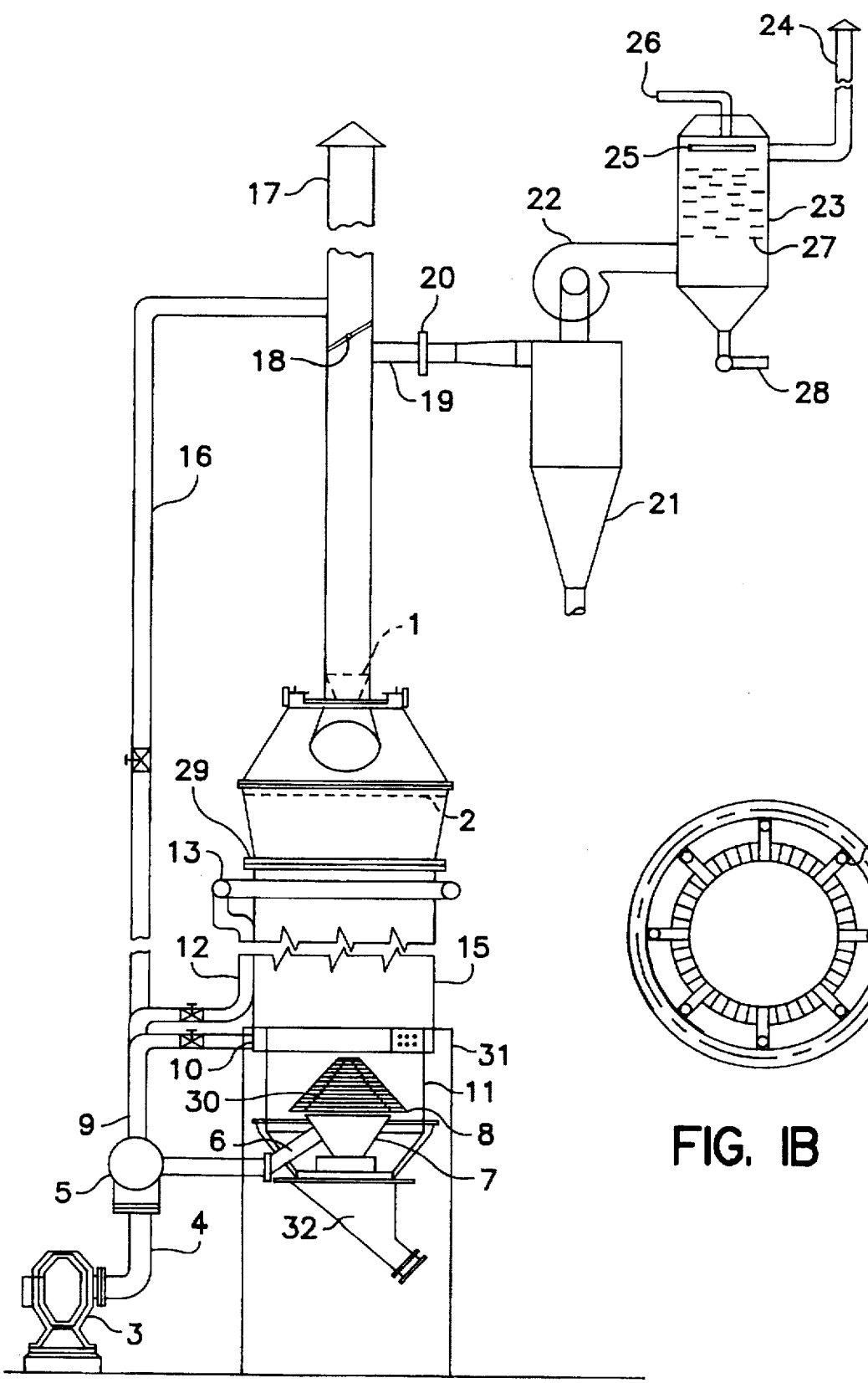
FIG. IA
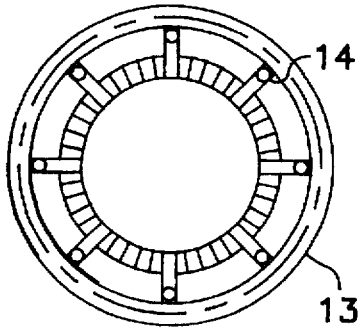
FIG. IB

VERTICAL SHAFT KILN

FIELD OF THE INVENTION

This invention relates to a novel vertical shaft kiln (VSK) useful for manufacturing cement and other allied products.

In the vertical shaft kilm (VSK) the infeed is homogenized raw material in the form of nodules containing required quantity of fuel, generally finely coke for combustion. These nodules are burnt in the sintering zone of the kiln and the required air for combustion is supplied from the bottom through rotary gate. The heat thus produced causes calcination of limestone and recombination of oxides forming cement clinkers. The hot clinkers are cooled in the cylindrical cooling zone by the incoming air from bottom of the kiln and then discharged through an air lock control discharge system. The rotary conical gate provided in the kiln facilitates variable discharge, crushes the lump formed and also distributes incoming air through its peripheral holes. At the top of the kiln a chimney/chimneys are provided for emission of flue gases.

PRIOR ART REFERENCES

U.S. Pat. No. 4,332,641 discloses an air injected vertical shaft kiln for burning carbonaceous material such as petroleum coke in the upper part of the vertical shaft to produce hydrogen and carbon monoxide and such gaseous product is withdrawn from a level below the combustion zone. The device of this patent is not suitable for sintering cement and other allied products and the construction of this kiln is entirely different from the vertical shaft kiln VSK of the present invention.

Another U.S. Pat. No. 4,347,120 mentions a vertical shaft kiln for calcining heavy hydrocarbonaceous materials such as green coke in the presence of stem injected at the bottom of the kiln to produce hydrogen. Here again, the vertical shaft kiln is not fit for calcining solid materials such as cement and its construction is totally different from the vertical shaft kiln now invented by the present applicants.

Yet another U.S. Pat. No. 4,352,661 describes a shaft kiln on which a hopper is mounted on the kiln and the heat energy generated at the shaft kiln is used to preheat the raw material present in the hopper. The construction, arrangement of various means and the function of this shaft kiln are in no way relating to the construction and function of the novel vertical shaft kiln now invented by the present applicants.

U.S. Pat. Nos. 4,409,068 and 4,407,700 provide radially disposed combustion gas injector located within the shaft kiln and such injector includes means for circulating coolant around the periphery of the injector and means for introducing recycle gas into the kiln. The system and arrangement disclosed in the above said U.S. Patents in no way provides any clue for the novel vertical shaft in disclosed in the present invention of the applicants.

Still another U.S. Pat. Nos. 4,718,984 discloses a vertical shaft kiln for calcining coke wherein the gas stream heated in the cooling chamber can be used as a co-current gas preheat stream in the upper section of the kiln. This patent is not at all relating to the applicants' present invention disclosing a novel vertical shaft kiln. One more U.S. Pat. No. 4,744,773 provides a vertical shaft kiln useful for calcining limestone, comprising a series of processing zones. The construction and the function of this patent is quite different from the novel vertical shaft kiln invented by the present applicants.

The hitherto known VSK has an air distribution system wherein air is supplied from the bottom either through annular spaces provided between grate plates and armoured shell or through the peripheral holes and central holes provided in the grate in various designs of VSK. Since there is a long voltage of clinker above the grate, air required for combustion of nodules in the sintering zone for complete combustion is mostly not uniformly available. Due to irregular bulk density of clinkers inside the cylindrical column, the distribution of air cannot be guaranteed for uniformity. As a result, uniform burning of clinker is not possible in the hitherto known VSK. Similarly, due to lack of air in some portions of the sintering zone, unburnt clinkers are produced. Since air supply is through the bottom of the kiln only, in the known device air tends to escape through the path of least resistance, i.e. through the clinker discharge nozzle. Due to this not only considerable amount of air is lost but also dust nuisance(pollution of environment) is created at clinker discharge in the existing VSK. The combustion gases emitted from VSK of hitherto developed construction or design contains solid particulates and other polluting gases often beyond permissible limits.

The main object of the present invention is to provide a Vertical Shaft Kiln (VSK) useful for manufacturing cement and other allied products, which obviates the drawbacks associated with hitherto known Vertical Shaft Kilns.

The present invention relates to a VSK wherein the supply of combustion air in appropriate quantity at the sintering zone is assured; to facilitate platform air supply for combustion of nodules, a secondary air duct is provided at the top of grate zone; to arrest the solid particulate and other emitted gases a cyclone separator and liquid scrubber is provided in the chimney. To ensure initial ignition of the kiln, a by-pass chimney with a butterfly valve wherein required air is blown for creation of necessary draught for initial and different running conditions of the kiln is provided. An electronic sensor is provided in the body of the kiln for ensuring and maintaining bed level in the kiln.

In the novel kiln of this invention, required quantity of air for combustion of green nodules is distributed in different proportion. Primarily, the total required air along with the required excess quantity is fed into an air header located near the armoured shell zone and fitted to the supporting structure of the kiln. From the air header a suitable duct is connected to the air cone below the grate plate. The secondary air duct drawn from air header is connected to a circular air box projected out from the top of the armoured shell. This air box has perforations on the inner wall for entrance of secondary air into the kiln. Another duct of required cross section is dram from the same air header and connected to another circular air header just below the sintering zone from which a numb& of air nozzles with required orifices are provided through the refractories around the sintering zone. Finally, another air duct from the common header is drawn and connected to the chimney above the butterfly valve. The total assembly of the air distribution system comprising of above mentioned ductings and common air header enables processing of any composition of raw material with a perfect distribution of total required air by adjusting controlled valves provided in the ductings & nozzles. In the earlier construction of VSK, the phenomenon of non uniformity of air distribution produced overburned and underburned nodules, and production losses due to lump formation causing air channeling effect in the crucial sintering zone of the vertical shaft kiln. By incorporating this new air distribution system, above problems are completely eliminated ensuring production of both quantity and quality of clinkers. Due to different moisture level in the green nodules, a large amount of smoke associated with various other gases and solid particulates are observed to be emitted through chimney of the VSK. This creates not only operational difficulties but also creates pollution problems in the operating platform. To minimise this problem, the air duct as mentioned is connected above the butterfly valve of the chimney for creation of additional draught. This helps in accelerating smoke emission through the chimney. The solid particulate matters and pollutant gases are taken care of in a suitably designed cyclone separator and liquid gas scrubber provided in the flue gas emission system.

The vertical shaft kiln of the present invention is further described with reference to the accompanying drawings which are provided only for illustration and are not exhaustive of possible embodiments of the invention.

In the drawings accompanying this specification,

FIG. 1(*a*) of the drawings represents the elevation view of the kiln incorporating air distribution devices, chimney with butterfly valve, cyclone separator and scrubber.

FIG. 1(*b*) of the drawings represents the top view of an air header with a plurality of air entry nozzles.

Accordingly, the present invention provides a vertical shaft kiln (VSK) usefull for manufacturing cement and other allied products, which comprises a rotary nodule feeder (1) for feeding the raw materials, fitted above the kilt bed (2) for uniform distribution of nodules of the raw materials, an air blower (3) being placed at the base of the kiln for feeding air through a duct (4) to a common air header (5) having a plurality of outlet air ducts (6,9,12 & 16), the air duct (6) being connected to an air cone (7) placed inside an armoured shell (11) of the VSK, the said air cone being provided with a grate assembly (8) having a plurality of peripheral air slots (30), the air duct (9) being connected to an air box (10) placed above the said armoured shell (11), the said air box having perforations (31) on the inside vertical wall, the air duct (12) being connected to an air header (13) having air entry nozzles (14) [ref. FIG.1(*b*)] placed in such a manner so as to supply air just below the sintering zone (15) of the VSK, the air duct (16) being connected to the chimney (17) of the VSK, the said chimney being provided with a butterfly valve (18) below the air duct (16), the chimney being also provided with a bypass duct (19) below the said butterfly valve, the bypass duct being connected through means (20) to a cyclone separator (21) fitted with a fan (22) for drawing the stack gases, the outlet of the cyclone separator being connected to an outlet duct (24) through a scrubber (23,25, 26,27&28), a sensor alarm (29) being provided on the VSK body to indicate fire bed level. The cement clinkers or the allied products are being removed through a discharge chute (32).

For production of proper quality and quantity of clinkers, maintenance of the bed level of the kiln is very important. When bed level falls below a certain limiting level, the air pressure drop also decreases, thereby causing increase of air supply in the sintering process, resulting in production of overburned clinkers. Moreover, the maintenance of bed level is also important because the sintering operation should be limited within the conical portion of the kiln. This is possible only if the bed level is maintained at a predetermined level. In the present invention, a sensor with an alarm (29) is provided to constantly monitor the bed level of the kiln. Green nodules of cement raw materials or minerals are fed through rotary nodule feeder (1). It distributes the nodules uniformly to kiln bed (2). Air from roots blower (3) passes through a common duct (4) to a common header (5) from which a primary air duct (6) enters an air cone (7) from which the air gets distributed through peripheral air slots in the grate assembly (8). Another air duct (9) is drawn from the same common air header (5) to air box (10) above the armoured shell (11). The inside vertical wall of the air box has perforations for entrance of air. Another air duct (12) drawn from the same common air header (5) passes along the wall of the film and supplies air to an air header (13) from which several air entry nozzles (14) as shown in FIG. 1(*b*) enter into the kiln just below the sintering zone (15). Another air duct (16) from the common air header (5) enters into chimney (17) down stream of the butterfly valve (18). A bypass line (19) drawn out from trunk of the chimney (17) has a flange joint (20) wherein a cyclone separator (21) is connected. Stack gases drawn by induced draught (I.D.) fan (22) after moving through this cyclone (21) pass through another liquid scrubber (23) which is counter current with smoke moving upwards, and then the gases pass through the duct (24) to the atmosphere while the liquid absorbent entering through pipe (26) sprayed through nozzles (25) moves downward and passes through the packing materials (27) and ultimately comes out through a pipe (28). Clinkers formed move downward in presence of air that enters through the different entry points (6), (10) and (14). A sensor with an alarm (29) is provided in suitable position at the body of the kiln to indicate fire bed level inside during operating of the kiln.

ADVANTAGES OF THE PRESENT INVENTION

In the present invention of VSK has distinct advantages in the distribution of air throughout the kiln for efficient burning of nodules over a broad range of burnable raw materials for production of cement and allied products. This invention also incorporates pollution control devices at the outlet of chimney providing scrubber and cyclone separators for arresting pollutant gases and solid particulates produced during processing operation. Further, the invention is suitable for incorporation of electronically controlled air, seal self controlled discharge devices for control of process air and dust pollution.

We claim:

1. A vertical shaft kiln (VSK) useful for manufacturing cement and other allied products and having a base, which comprises a rotary nodule feeder for feeding raw materials, fitted above a kiln bed for uniform distribution of nodules of the raw materials, an air blower being placed at the base of the kiln for feeding air through an inlet duct to a common air header having a plurality of outlet air ducts including a first outlet air duct, a second outlet air duct, a third outlet air duct and a fourth outlet air duct, the first outlet air duct being connected to an air cone placed inside an armoured shell of the VSK, said air cone being provided with a grate assembly having a plurality of peripheral air slots, the second air duct being connected to an air box placed above said armoured shell, said air box having perforations on its inside vertical wall, the third air duct being connected to an air header having air entry nozzles placed in such a manner so as to supply air just below a sintering zone of the VSK, the fourth air duct being connected to a chimney of the VSK, said chimney being provided with a butterfly valve below the fourth air duct, the chimney being further provided with a bypass duct below said butterfly valve, the bypass duct being connected through a connecting means to a cyclone separator fitted with a fan for drawing the stack gases, an outlet of the cyclone separator being connected to an outlet duct through a scrubber, a sensor alarm being provided on the VSK body to indicate fire bed level, the products being removed through a discharge chute.

2. A vertical shaft kiln (VSK) as claimed in claim 1 wherein the scrubber used is of liquid absorbent spray type.

* * * * *